US006772901B2

(12) United States Patent
Witt

(10) Patent No.: US 6,772,901 B2
(45) Date of Patent: Aug. 10, 2004

(54) TAMPER RESISTANT COMPOSITE LIDS FOR FOOD CONTAINERS

(75) Inventor: Stephen H. Witt, Smithville (CA)

(73) Assignee: Stanpac Inc., Smithville (CA)

( * ) Notice: Subject to any disclaimer, the term of this patent is extended or adjusted under 35 U.S.C. 154(b) by 0 days.

(21) Appl. No.: 10/146,877

(22) Filed: May 17, 2002

(65) Prior Publication Data

US 2002/0170914 A1 Nov. 21, 2002

Related U.S. Application Data

(60) Provisional application No. 60/291,618, filed on May 18, 2001.

(51) Int. Cl.[7] ..... B65D 17/40

(52) U.S. Cl. ..... 220/276; 220/270

(58) Field of Search ..... 220/266, 270, 220/276, 780, 794, 796; 229/5.5, 5.84

(56) References Cited

U.S. PATENT DOCUMENTS

| | | | | | |
|---|---|---|---|---|---|
| 4,147,268 | A | * | 4/1979 | Patel et al. | 215/252 |
| 4,301,941 | A | * | 11/1981 | Kraft | 220/780 |
| 4,476,993 | A | | 10/1984 | Krout | 220/276 |
| 4,779,754 | A | * | 10/1988 | Ten Eyck et al. | 220/254.1 |
| 4,782,968 | A | | 11/1988 | Hayes | 215/276 |
| 4,998,622 | A | * | 3/1991 | Drack | 206/519 |
| 5,002,198 | A | * | 3/1991 | Smith | 220/276 |
| 5,027,969 | A | * | 7/1991 | Lesquir | 220/270 |
| 5,052,574 | A | * | 10/1991 | McKinnon et al. | 220/276 |
| 5,170,905 | A | * | 12/1992 | Luch | 220/276 |
| 5,249,694 | A | * | 10/1993 | Nelson | 220/276 |
| 5,271,517 | A | * | 12/1993 | Bowers | 220/276 |
| 5,395,003 | A | * | 3/1995 | Matsuda | 220/270 |
| 5,540,342 | A | | 7/1996 | Rathbun | 215/225 |
| 5,658,228 | A | | 8/1997 | Van de Geijn et al. | 493/101 |
| 5,779,050 | A | * | 7/1998 | Kocher et al. | 206/497 |
| 5,875,908 | A | | 3/1999 | Witt et al. | |
| 5,882,746 | A | * | 3/1999 | Hoffman | 428/34.2 |
| 6,053,353 | A | | 4/2000 | Helms | |
| 6,341,707 | B1 | | 1/2002 | Witt et al. | |
| 2003/0071043 | A1 | * | 4/2003 | Davis | 220/276 |

FOREIGN PATENT DOCUMENTS

| | | | |
|---|---|---|---|
| WO | WO 97/35779 | 10/1997 | B65D/51/14 |

* cited by examiner

*Primary Examiner*—Nathan J. Newhouse
*Assistant Examiner*—James Smalley
(74) *Attorney, Agent, or Firm*—Ridout & Maybee LLP

(57) ABSTRACT

A tamper-resistant, tamper-evident composite lid is disclosed for use with containers having a peripheral lip formation around the opening thereof, such as an ice cream container. The closure member comprises integral outer and inner cylindrical ring portions which present at their upper peripheral margin a downwardly stepped annular ledge formation for adhesively receiving a paperboard or other flexible cover panel. The inner ring portion presents a plurality of resiliently deformable teeth extending upwardly and inwardly from its lower peripheral margin configured to lockingly engage with the lip of the container for sealing. The inner ring is circumscribed by a rupturable line of weakness which ruptures upon any attempt to prise off the lid, providing evidence of tampering. The container is legitimately opened by manually tearing away the bottom portion of the inner ring along its line of weakness.

6 Claims, 7 Drawing Sheets

14
10
16
11

A

TAMPER RESISTANT COMPOSITE LIDS FOR FOOD CONTAINERS

RELATED APPLICATION

This application is a replacement of Provisional Application No. 60/291,618 filed on May 18, 2001 and entitled TAMPER-EVIDENT LID FOR FOOD CONTAINER.

FIELD OF THE INVENTION

This invention relates to tamper-resistant, tamper-evident composite lids for containers for products presenting significant concerns for the consumer about unauthorized tampering with the product (e.g. food products and other consumables) or unintended release of the product (e.g. hazardous chemical compositions).

By a "composite" lid, is meant a lid composed of a sheet of printed matter (e.g. paperboard) serving as the cover top panel and a molded plastic rim bonded to and compatible with the panel material to form the means for engaging the lid to the container. U.S. Pat. No. 6,053,353 (Helms) exemplifies a composite container closure of this kind. Where they are capable of being used instead of wholly plastic lids, composite lids allow for reduced material costs and superior lid-top graphics.

BACKGROUND OF THE INVENTION

In recent years, concerns have increased surrounding potential and actual incidents of malicious contamination of packaged foods and medicine.

Preventive measures taken in the packaging of non-prescription analgesic medicine are well know. A number of tamper-resistant closures have also been introduced for screw-cap bottles, as in U.S. Pat. No. 4,394,918 (Grussen). Tamper-resistant push-on cap assemblies for re-usable glass bottles (e.g. milk bottles) are described in U.S. Pat. Nos. 5,875,908 (Witt et al) and 6,341,707 (Witt et al), owned in common with the present application.

In the ice cream packaging industry, a variety of closure arrangements are used to hold a paperboard, plastic or composite lid in place on the paperboard container or tub holding the ice cream. None of the ice cream containers currently in use employs the sort of protection against tampering that is common in other types of food packaging. A chief reason for this lies in the increased cost in including a tamper-evident feature in the lid, as well as the limited space available in processing plants for equipment which would apply such a feature.

A small segment of the ice-cream production market does make use of a heat-sealed film over the container opening, but this is far from satisfactory from the aspect of clearly indicating any post-packaging tampering with the product.

It is of great and increasing importance that the consumer, at the point of purchase of a product, be confident that the package that he or she intends to purchase has not been compromised. If there is a problem with the packaging which can not be spotted until the consumer opens it for use, he or she may well never purchase that product again and consumer confidence is reduced generally.

SUMMARY OF THE INVENTION

It is a general object of the invention to provide a composite container closure member that can be used to resist and to render readily detectable tampering of the products at the point of sale. Particular examples include dairy products, cosmetics, granular or powdered food products such as tubs for bread crumbs, hardware product tubs for screws, nuts and bolts, and so on.

It is a particular object of the present invention to provide a tamper-resistant tamper-evident lid for ice cream and other dairy products that is commercially practical and provides the level of tamper evidence needed for food safety.

With a view to these and other objects the present invention provides a closure made of economical raw materials, which may be applied to the container at the time of packaging using existing capping equipment with minor modifications that require no additional operating space. The present invention provides a new and improved composite lid for containers of the kind having an opening with a peripheral lip formation, such as a standard ice cream container.

A tamper-evident container closure member according to the present invention comprises an outer cylindrical ring portion having an upper peripheral margin and a lower peripheral margin and an inner cylindrical ring portion having a lower peripheral margin which extends vertically below that of the outer cylindrical ring and an upper peripheral margin integrally connected to the outer cylindrical ring portion by an annular ledge formation that serves as the seat for a central top panel formed from a blank of generally flexible sheet material.

At a vertical position intermediate the lower peripheral margin of the outer cylindrical ring portion and its own lower peripheral margin, the inner cylindrical ring portion is circumscribed by a rupturable line of weakness formed, for example, by thinning the plastic material along an inner circumferential line.

A plurality of resiliently deformable teeth extend upwardly and inwardly from the lower peripheral margin of the inner cylindrical ring portion of the closure. These teeth are configured for engagement of the lip of a container when the closure member is in place.

The top panel of the lid is typically of waterproofed paperboard or like material bearing the desired graphics on the outside and is sealed against the annular ledge that connects the outer to the inner ring portion of the closure. Preferably, the upper edge surface of this ledge is downwardly recessed relative to the upper peripheral margin of the outer ring, to prevent manual access to the peripheral edge of the cover panel.

When the lid is pushed on to the container having a lip about the top opening, the teeth on the inner ring portion lock on to the container lip. Rupture of the inner ring along the line of weakness permits removal of the rest of the lid closure with cover panel, to open the container, while the tamper-evidencing lower portion of the inner ring can simply be pulled away from the container and disposed of by the consumer.

DESCRIPTION OF THE PREFERRED EMBODIMENT

Figure 1:
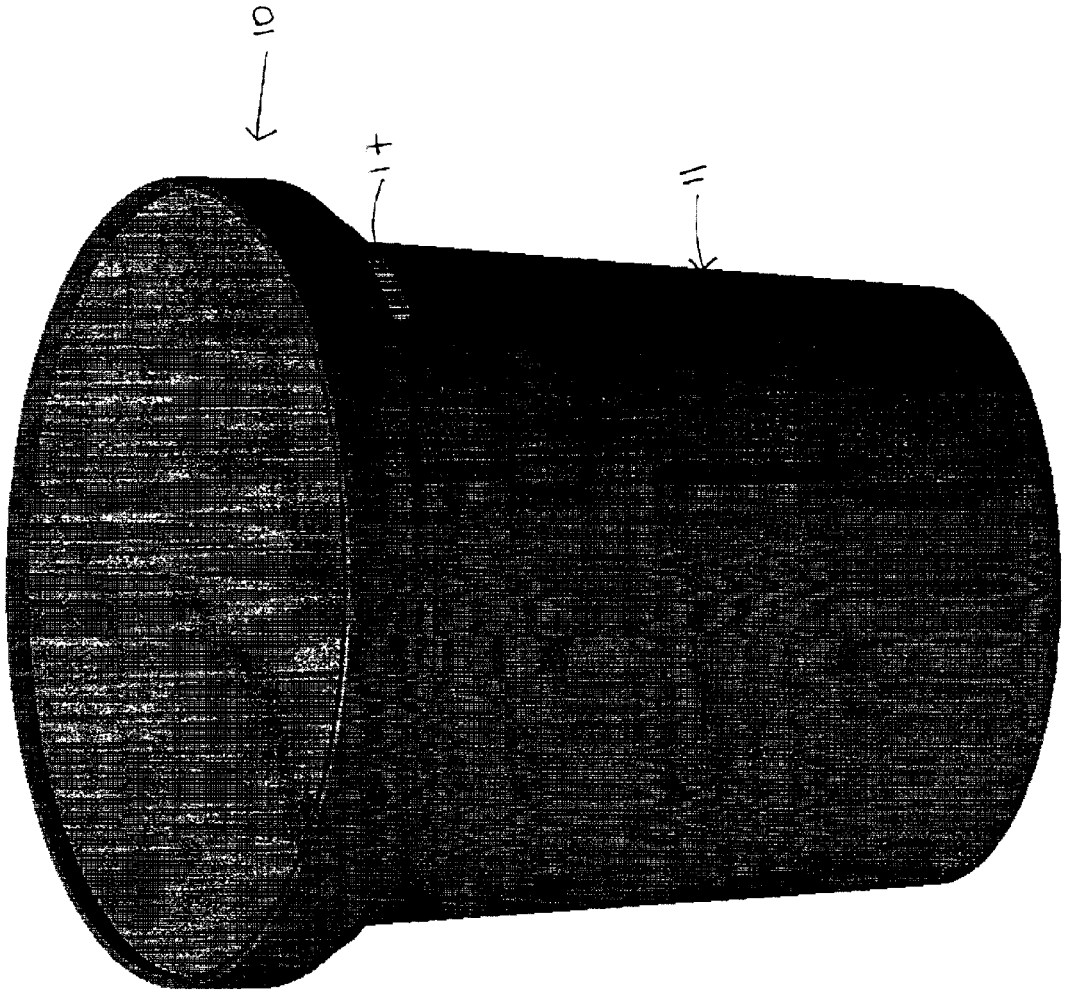
FIG. 1 is a top perspective view of a conventional ice cream container, with closure means according to the present invention.

As seen in the accompanying drawings, a tamper-evident closure according to the present invention (indicated generally by reference numeral 10) and adapted to seal a conventional ice cream container 11, comprises an outer cylindrical ring 14 with upper and lower margins 14*a* and 14*b*, respectively and an inner cylindrical ring portion 16 with upper and lower peripheral margins 16*a* and 16*b*, respectively. Extending upwardly and inwardly from the lower peripheral margin of inner ring portion 16 is a circumferentially spaced plurality of teeth 16*c* which lock under rolled rim 11*a* of container 11 when the lid is first pushed downwardly to seal the container.

Figure 6:
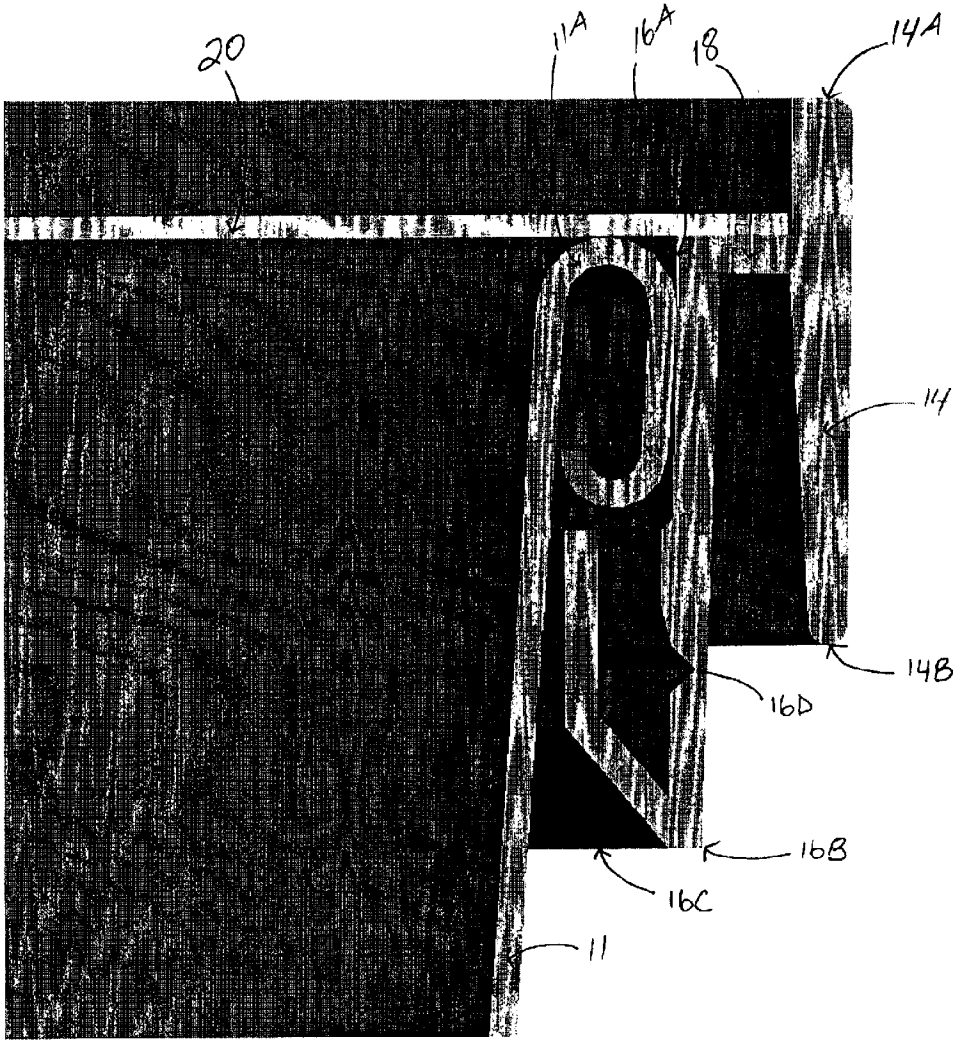
FIG. 6 is a detailed view of the mutually engaging components of the container and lid when assembled.
Figure 7:
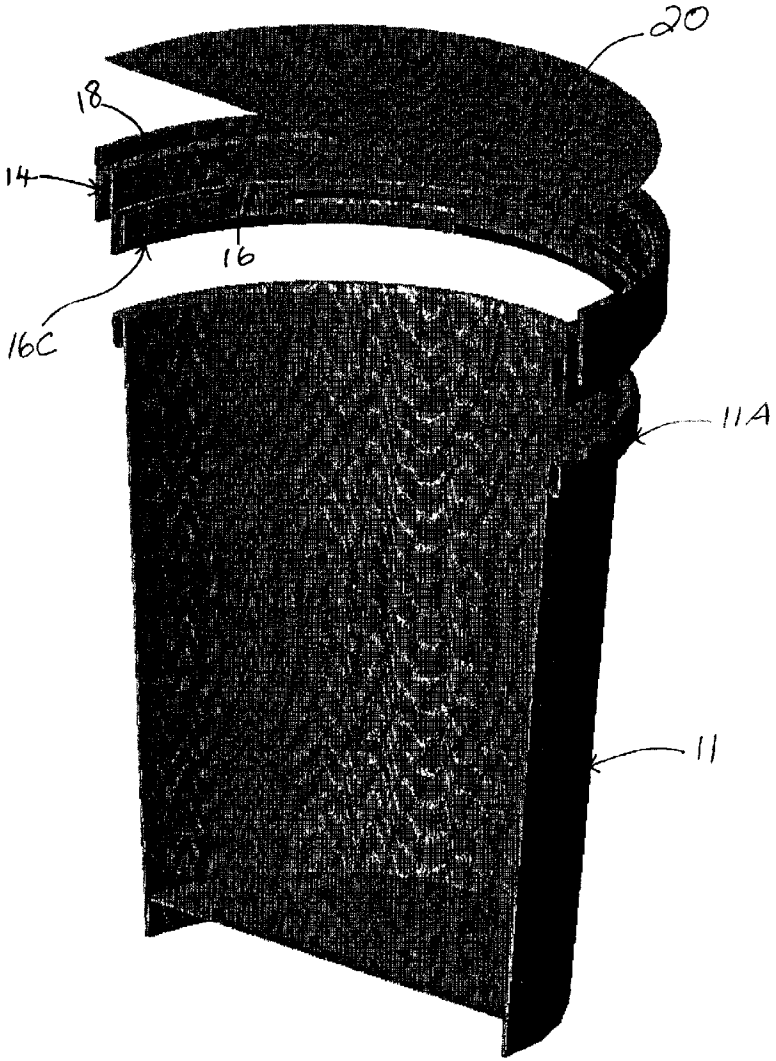
FIG. 7 is an exploded view of the sectional perspective of FIG. 5.

Also, as best seen in FIG. 6, a circumferential portion of the wall of inner cylindrical ring 16 is thinned and weakened, here by a circumferential notch 16*d*. Legitimate opening of the container by a consumer starts by separation of the two portions of the inner cylindrical ring by tearing away the lower part thereof along the line of weakness 16*d*.

Figure 2:
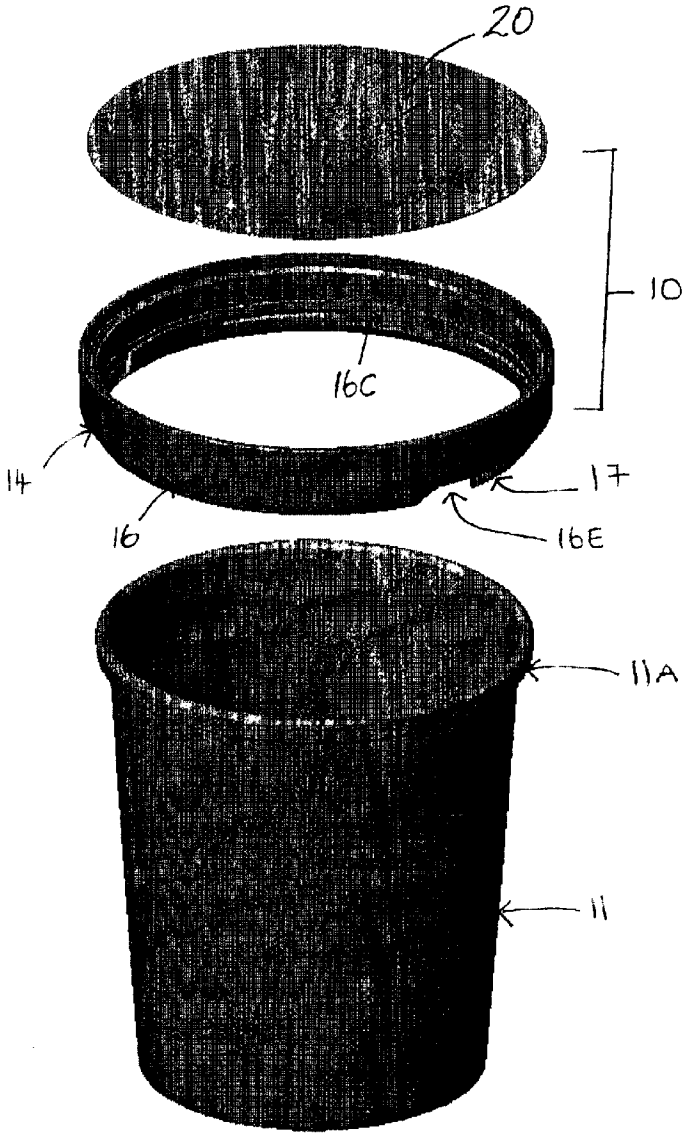
FIG. 2 shows the container and closure means with the lid components in an exploded arrangement.
Figure 3:
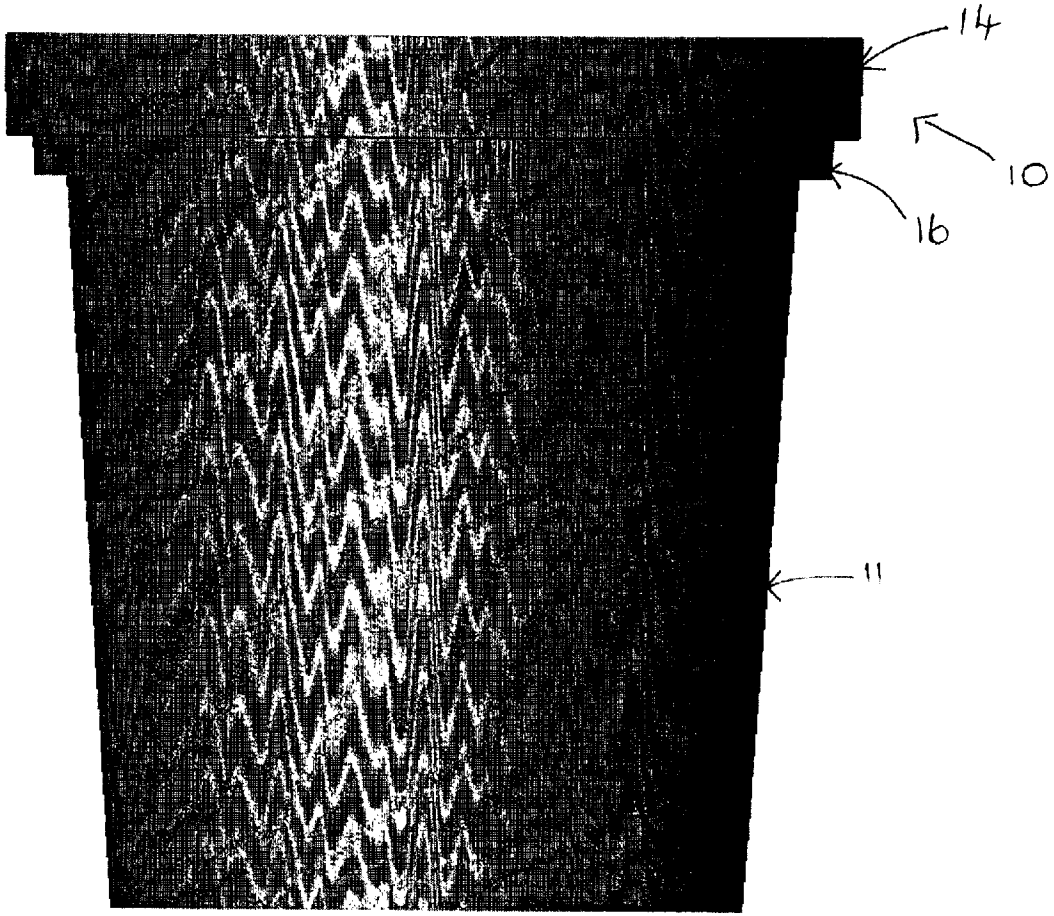
FIG. 3 is a side elevational view of the container and lid of FIG. 1.
Figure 4:
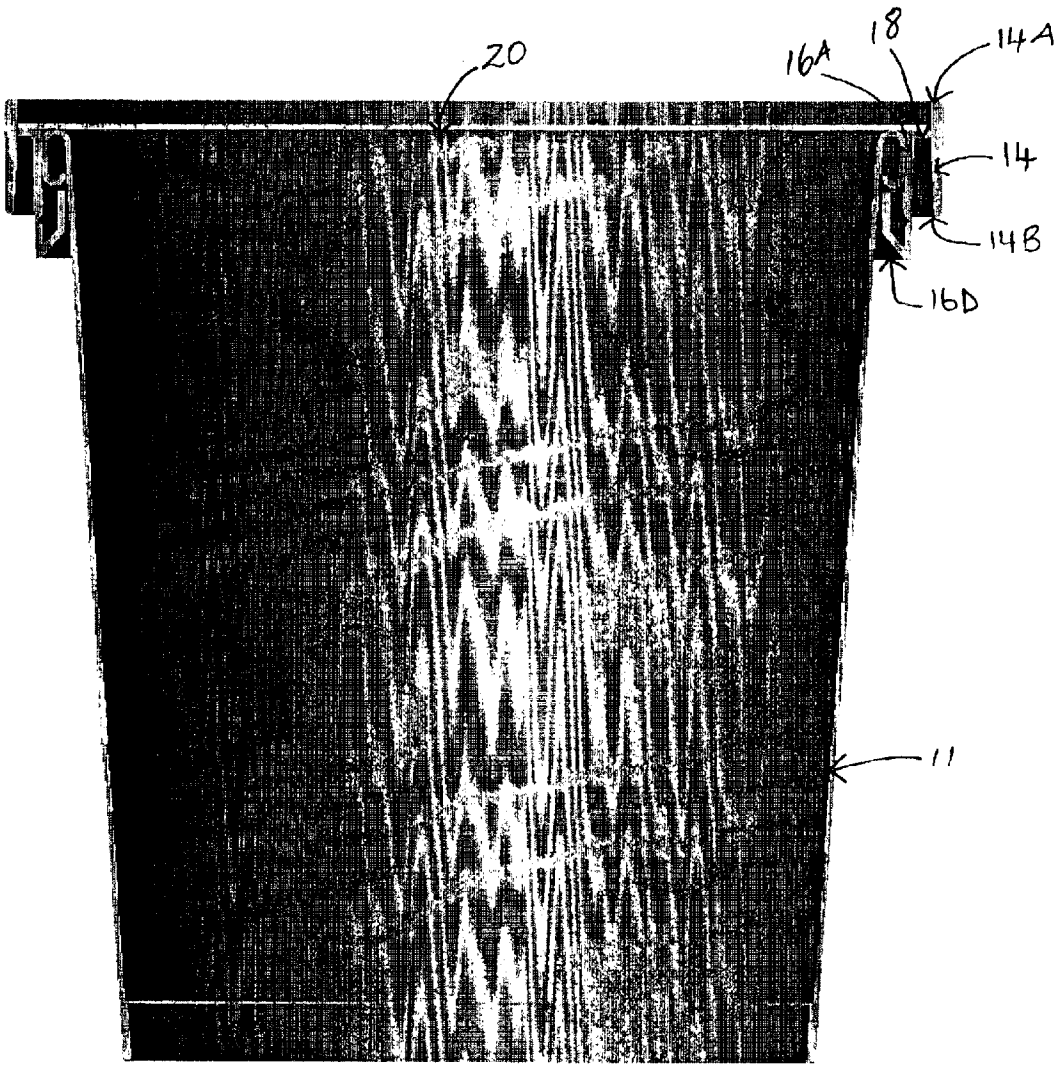
FIG. 4 is a vertical cross-sectional view taken along the central axis of FIG. 3.
Figure 5:
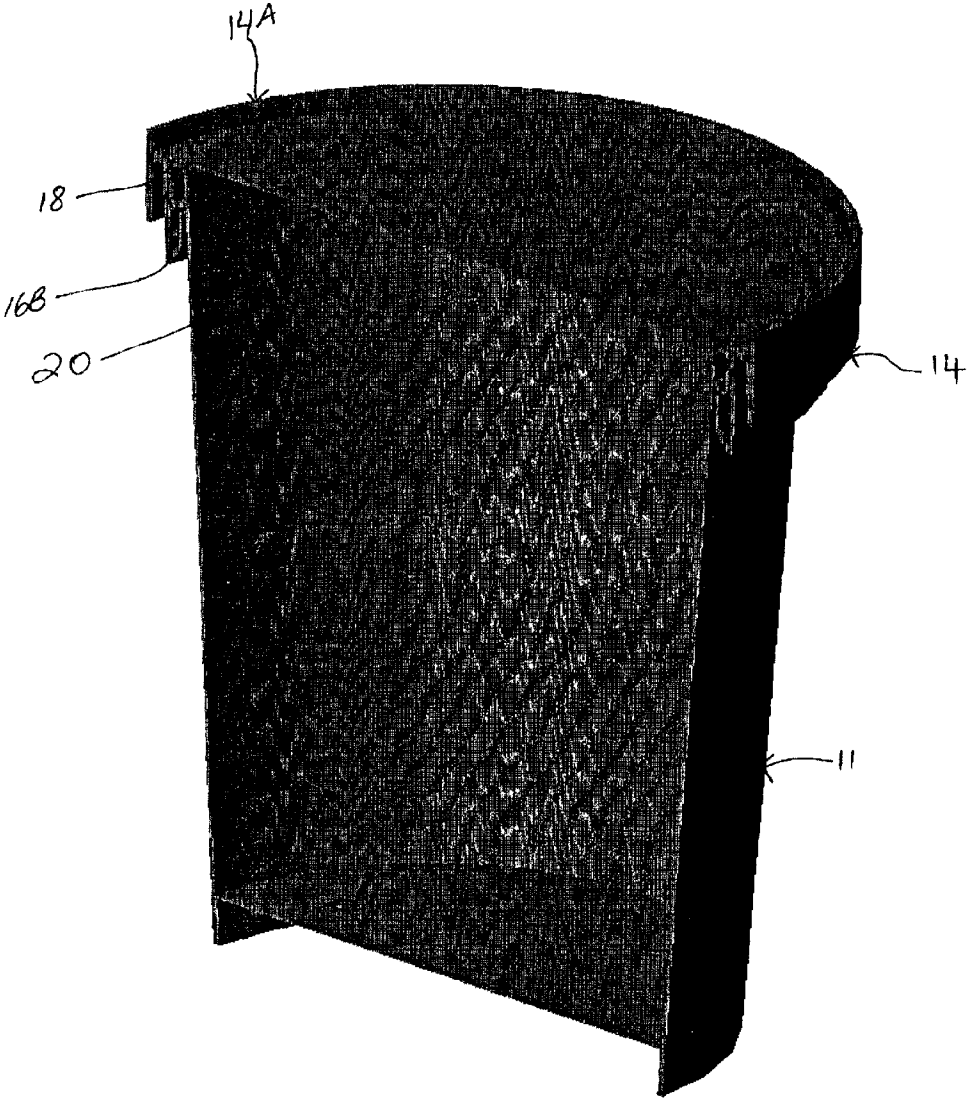
FIG. 5 is the sectioned container and lid arrangement of FIG. 4 seen from a top perspective.

For convenience in legitimately opening the container, the inner cylindrical ring 16 is provided with gripping means. In the embodiment depicted and as best seen in FIG. 2, the lower portion of inner cylindrical ring 16 is formed with a thumb notch 16*e* disposed at a location on the lower periphery. By exerting moderate force on the accessible edge portion 17, that part of inner ring 16 below the line of weakness 16*d* can be removed with teeth 16*c*, as a tear-away strip. The line of weakness is ruptured and the lower, teeth-carrying portion of the inner ring 16 is easily removed from the closure and from the container.

The one-piece injection-molded closure means consisting of outer ring 14, inner ring 16 with its associated dependant teeth 16*c* is formed with a thin circumferential ledge 18 joining the upper peripheral margin 16*a* of the inner ring to the inside wall of outer ring 14. The top portion 20 of the lid consists of a paper disk or the like that may be printed on its upper side for product identification, marketing information, graphics etc. Particularly for use with ice-cream and food products, the paper disk 20 will have a polymer layer attached to the underside for keeping moisture from the product from entering through the paper, as well as to enable the paper disk to be bonded to plastic ledge 18.

In the embodiment illustrated, the top portion 20 is peripherally sealed to downwardly-recessed annular ledge 18. In assembly, the poly-coated disk 20 and ledge 18 are bonded together by fusing the poly-layer to the top of ledge 18, by induction heating or ultrasonic welding or spin welding. Alternatively, a coating of suitable adhesive may be applied to either of the facing surfaces prior to insertion of disk 20 into the top recess of the closure formed by the upper most portion of outer ring 14.

Once assembled, outer ring 14, tamper-evidencing inner ring 16 and the cover disk 20 together form the composite closure. In existing composite closures, the paper disk is placed over a plastic layer molded to the side wall of the closure. Using the present invention, that plastic layer may be eliminated to achieve a considerable savings in material and reduced costs of manufacturing.

Unlike existing tamper-evidencing features such as inner seals, neck bands, labels, etc. the closure according to the present invention can be applied at the dairy with a single piece of equipment, an important advantage in cramped production areas.

By contrast with prior art composite container closures, in which the paper lid portion is molded right into the container side wall, the closure of the present invention allows paper disk 20 to be completely removed from the plastic ring, making recycling a simple matter.

While only a single embodiment of the present invention has been illustrated, those of ordinary skill in the art will appreciate that a number of modifications might be made without departing from the spirit of the present invention, which is defined in the claims attached hereto. For example, a solid resilient ring might be used on the tear-away strip portion of the closure instead of individual tamper-evident teeth. The line of weakness could be defined by forming gaps along a circumference of the lower ring. In lieu of paperboard, different flexible sheet materials might be used, according to the final intended application. The inside wall of the inner cylindrical ring could be formed with threads to adapt the closure for use on a threaded container.

I claim:

1. A composite closure member for a container having an opening with a peripheral, lip formation, comprising:

an outer cylindrical ring portion having an upper peripheral margin and a lower peripheral margin;

an inner cylindrical ring portion having an upper peripheral margin [integrally joined to said outer cylindrical ring portion by an annular ledge formation] and a lower peripheral margin extending vertically below the lower peripheral margin of the outer cylindrical ring portion, the upper peripheral margin of said inner cylindrical ring portion being joined integrally to said outer cylindrical ring portion at a position intermediate the upper and lower margins thereof by an annular ledge formation, and said inner cylindrical ring portion being circumscribed by a rupturable line of weakness vertically below the lower peripheral margin of said outer cylindrical ring portion;

a plurality of resiliently deformable teeth depending from the lower peripheral margin of said inner cylindrical ring portion in an upward and inward direction, for locking engagement against the lip of the container when the closure member is in place; and a cover panel formed from generally flexible sheet material, peripherally sealed to said annular ledge formation.

2. A composite closure member according to claim 1, wherein said outer cylindrical ring portion, said inner cylindrical ring portion and said resiliently deformable teeth are formed of plastic material in a single injection molding step.

3. A composite closure member according to claim 1 or 2, wherein said rupturable line of weakness is formed as the apex of a triangular circumferential groove along the inner wall of said inner cylindrical ring portion.

4. A composite closure member according to claim 2, wherein a thumb notch is formed in the lower peripheral margin of said inner cylindrical ring portion to permit ready gripping and tearing a part of the inner ring below said frangible line of weakness.

5. A composite closure member according to claim 2, wherein said cover panel is formed from paperboard.

6. A composite closure member according to claim 5, wherein the underside of said cover panel is coated with plastic and is sealed to said annular ledge formation by heat welding.

* * * * *

UNITED STATES PATENT AND TRADEMARK OFFICE

CERTIFICATE OF CORRECTION

PATENT NO. : 6,772,901 B2
DATED : August 10, 2004
INVENTOR(S) : Stephen H. Witt

It is certified that error appears in the above-identified patent and that said Letters Patent is hereby corrected as shown below:

Column 4,
Lines 26-27, "integrally joined to said outer cylindrical ring portion by an annular ledge formation", should be deleted.

Signed and Sealed this

Eighth Day of March, 2005

JON W. DUDAS
*Director of the United States Patent and Trademark Office*